United States Patent [19]

Barth et al.

[11] Patent Number: 4,583,341

[45] Date of Patent: Apr. 22, 1986

[54] INTERLOCKING GROUND COVERING ELEMENTS AND ARRANGEMENTS OF THEM FOR MECHANICAL LAYING

[75] Inventors: Günter Barth, Bühlertal; Fritz von Langsdorff, Förch über Rastatt, both of Fed. Rep. of Germany

[73] Assignee: F. von Langsdorff Bauverfahren GmbH, Rastatt, Del.X

[21] Appl. No.: 369,539

[22] Filed: Apr. 19, 1982

[30] Foreign Application Priority Data

Apr. 24, 1981 [DE] Fed. Rep. of Germany ... 8112270[U]

[51] Int. Cl.[4] ..... E04C 1/10

[52] U.S. Cl. ..... 52/589; 52/590; 52/314

[58] Field of Search ..... 52/589, 590, 557, 558, 52/314, 315, 568–572, 591–596, 436–439; 403/41, 42

[56] References Cited

U.S. PATENT DOCUMENTS

| | | | |
|---|---|---|---|
| 474,339 | 5/1892 | Graham | 404/41 |
| 888,530 | 5/1908 | Pugh | 52/590 |
| 3,494,266 | 12/1967 | Baumberger | 404/42 |
| 3,897,164 | 7/1975 | Dodino | 404/41 |
| 4,016,692 | 4/1977 | Jordan et al. | 52/314 |
| 4,031,678 | 6/1977 | Schuring | 52/589 |
| 4,217,740 | 8/1980 | Assanti | 52/590 |

FOREIGN PATENT DOCUMENTS

| | | | |
|---|---|---|---|
| Des. 65888 | 2/1975 | Australia . | |
| 670640 | 1/1966 | Belgium . | |
| 1195570 | 6/1970 | Canada | 52/569 |
| 0015426 | 9/1980 | European Pat. Off. . | |
| 1119315 | 12/1961 | Fed. Rep. of Germany . | |
| 1851235 | 3/1962 | Fed. Rep. of Germany . | |
| 1878044 | 8/1963 | Fed. Rep. of Germany . | |
| 1909028 | 1/1965 | Fed. Rep. of Germany . | |
| 1926253 | 11/1965 | Fed. Rep. of Germany . | |
| 1930053 | 12/1965 | Fed. Rep. of Germany . | |
| 1944339 | 8/1966 | Fed. Rep. of Germany . | |
| 1948744 | 11/1966 | Fed. Rep. of Germany . | |
| 1983563 | 4/1968 | Fed. Rep. of Germany . | |
| 1988249 | 6/1968 | Fed. Rep. of Germany . | |

(List continued on next page.)

OTHER PUBLICATIONS

F. V. Langsdorff, Uni-Coloc TM The Interlocking Paving Stone for Mechanized Installation, prior to Mar. 1982.

Shackel, "Subbase Design for Interlocking Concrete Block Pavements", Canadian Portland Cement Association, Toronto, Canada, Jan. 27, 1983—cover and p. 18.

*Primary Examiner*—Donald G. Kelly
*Assistant Examiner*—Andrew Joseph Rudy
*Attorney, Agent, or Firm*—Albert C. Johnston

[57] ABSTRACT

Modular interlocking paving elements of uniform configuration are provided each in the form of a substantially right angular body bounded peripherally by two outer sides meeting at an outer angle apex, two inner sides meeting at an inner angle apex and two front sides each extending between respective ends of an inner side and an outer side, with dummy joint gaps formed in and extending across the top side of the body each from the inner angle apex to a midpoint of one of the outer sides. The inner sides, front sides, half sections of outer sides and dummy gaps are of substantially the same length, and each has longitudinal portions thereof projecting outside and/or recessed inside a straight base line between the ends thereof, so that the top side of each element appears to be composed of three four-sided elemental units disposed side by side and two or more of the elements will interlock laterally yet present the same surface appearance in any of a variety of side-by-side orientations. The projection/recess configuration preferably is constituted by oblique surface portions alternating in direction. The dummy gaps form predetermined breaking regions along which an element upon being overloaded will break preferentially, thus preserving both its top side appearance and an interlocking relationship. The elements are particularly suitable for being arranged in groups that can be lifted, transported and laid as units by mechanical laying apparatus.

11 Claims, 5 Drawing Figures

FOREIGN PATENT DOCUMENTS

| | | |
|---|---|---|
| 6942620 | 11/1969 | Fed. Rep. of Germany . |
| 1534268 | 2/1970 | Fed. Rep. of Germany . |
| 1658570 | 8/1970 | Fed. Rep. of Germany . |
| 1459739 | 10/1970 | Fed. Rep. of Germany . |
| 1534227 | 10/1970 | Fed. Rep. of Germany . |
| 1784497 | 8/1971 | Fed. Rep. of Germany . |
| 2015463 | 10/1971 | Fed. Rep. of Germany . |
| 7211515 | 6/1972 | Fed. Rep. of Germany . |
| 2141107 | 3/1973 | Fed. Rep. of Germany . |
| 2213727 | 10/1973 | Fed. Rep. of Germany . |
| 7409912 | 6/1974 | Fed. Rep. of Germany . |
| 7412669 | 7/1974 | Fed. Rep. of Germany . |
| 2305601 | 8/1974 | Fed. Rep. of Germany . |
| 7420975 | 10/1974 | Fed. Rep. of Germany . |
| 2356742 | 5/1975 | Fed. Rep. of Germany . |
| 2515210 | 10/1975 | Fed. Rep. of Germany . |
| 2444497 | 4/1976 | Fed. Rep. of Germany . |
| 4448312 | 4/1976 | Fed. Rep. of Germany . |
| 2452475 | 5/1976 | Fed. Rep. of Germany . |
| 7622670 | 12/1976 | Fed. Rep. of Germany . |
| 2645430 | 4/1978 | Fed. Rep. of Germany . |
| 2707558 | 8/1979 | Fed. Rep. of Germany . |
| 7921936 | 10/1979 | Fed. Rep. of Germany . |
| 2836980 | 3/1980 | Fed. Rep. of Germany . |
| 2856198 | 7/1980 | Fed. Rep. of Germany . |
| 1164888 | 5/1958 | France . |
| 2398142 | 2/1979 | France . |
| D800651 | 1/1981 | South Africa . |
| 433742 | 8/1935 | United Kingdom . |
| 1183489 | 3/1970 | United Kingdom . |

INTERLOCKING GROUND COVERING ELEMENTS AND ARRANGEMENTS OF THEM FOR MECHANICAL LAYING

GENERAL DESCRIPTION OF THE INVENTION

The instant invention relates to a ground covering element, the peripheral surface of which comprises projections and recesses for interlocking engagement with ground covering elements laid adjacent the first one.

Ground covering elements of this kind are known with a great variety of configurations of the projections and recesses. As viewed from the top, they usually are of elongated shape, have but one general direction of extension, frequently the basic form being rectangular when figured without the projections and recesses. The compound effect of such ground covering elements with adjacent ground covering elements is obtained by mutual interlocking by means of the projections and recesses and by the respective laying pattern and can be influenced only by changes of these two parameters.

It is the object of the present invention to provide a ground covering element having improved compound effect and favorable reaction to overloading.

To meet this object, it is provided in accordance with the invention, that, in top view, the ground covering element is of angular shape having at least one angular change of its general direction of extension, and that two dummy gaps each are provided in the top side of the ground covering element, starting from the inner angle corner or corners at the periphery of the ground covering element and exactly or substantially continuing the course of the two peripheral section which adjoin the respective inner angle corner.

The angular shape in conjunction with the projections and recesses of the ground covering element provides improved compound effect between adjacent ground covering elements since the shape itself contributes to the compound effect and since the resulting tooth length is greater as compared to the conventional configurations of ground covering elements. The improved compound effect has its advantage not only when the ground covering elements are laid but also, for instance, when a plurality or group of contiguously disposed ground covering elements are grasped mechanically at the same time. Ground covering elements of angular shape are more susceptible than ground covering elements of conventional configuration to the formation of cracks which start from the inner angle corners when a certain load is surpassed. The dummy gaps provided in accordance with the invention predetermine the course of any rupture so that upon overloading the ground covering element will not break at random into small or irregular parts which are not nice optically or unfavorable for later loading. In addition, the dummy gaps give the ground covering element in aesthetically pleasant appearance so that the angular shape which frequently is not believed to be good looking, is no longer apparent or almost not recognizable at all when an area is covered. Finally, the ground covering elements in accordance with the present invention, for being angular in shape, have much less tendency to tilt when laid, as loads are applied to marginal zones, for instance the loading of vehicle wheels passing over the same, than is the case with oblong ground covering elements when these are loaded along their lengthwise marginal zones.

The projections and recesses, in other words the deviations from the general direction of extension of the sides of the ground covering element may be formed by curved faces and/or by faces which extend obliquely to the general direction of extension of the sides of the element or by a combination of such curved or obliquely extending faces with faces which extend parallel to the general direction of extension of the sides of the element. Specific embodiments hereof will be described below. It is favorable to provide the projections and recesses at all sides of the ground covering element.

Normally, the dummy gaps, starting from an inner angle corner, extend to a point where they meet the circumference of the ground covering element at a different place. The dummy gaps usually are formed by a gap starting at the top side of the ground covering element and extending down into the same to a certain depth. In certain areas, however, the dummy gaps may extend all the way through from top to bottom of the ground covering element so that the two ground covering element portions at either side of the respective dummy gap are interconnected by one or more isolated bridges of material. The choice of the respective depth of the dummy gap and/or of the thickness or width, respectively, of the bridges of material provides a means of deciding how far to go with the weakening of the cross section of the ground covering element in these regions. Further dummy gaps may be provided in the top side of the ground covering element in addition to those two each which start from the inner angle corner or corners.

The expression "dummy gaps exactly continuing the course of the two adjoining peripheral sections" is meant to indicate that the general direction of extension of the adjoining side sections of the ground covering element, in other words without taking into consideration the projections and recesses, is exactly and/or that the projection/recess trace of the adjoining peripheral sections is continued exactly in the dummy gaps. The expression "dummy gaps substantially continuing the course of the two adjoining peripheral sections" is meant to indicate that the general direction of extension of the adjoining side sections of the ground covering element is continued substantially only and/or that the projection/recess trace of the adjoining peripheral sections is continued substantially only.

A preferred embodiment of the ground covering element according to the invention is characterized in that the projections and recesses are provided relative to an imaginary closed base line composed of a first plurality of base line sections which are parallel to one another and a second plurality of base line sections which are parallel to one another, the base line sections of the second plurality extending at right angles to the base line sections of the first plurality. The base line interconnects the corners of the ground covering element and the peripheral surface may be said to oscillate about the base line to determine the projections and recesses. Such an embodiment results in a geometrically clearly divided configuration of the ground covering element, offering ground covering elements which can be laid easily and well and often in different selected relative positions.

A particularly preferred further development of the invention is the ground covering element in which the angular shape is formed by an outer angled side, an inner angled side and two front sides each leading from an end of the inner angled side to an end of the outer angled side. This further development presents a ground covering element with only one angular change of its general direction of extension so that it may be said to be of V-shape. This term is to comprise an angular change by any desired angle, but such change at right angles is particularly preferred. Preferably, the two resulting legs of the angle shape of the ground covering element have the same length and preferably the fundamental base line is symmetrical to the straight line passing through the angle apices of the outer and inner angle sides.

A characteristic which is especially significant for practical use of the ground covering elements according to the invention, in particular those according to the further development mentioned above, is that they may be arranged and laid so that the (space) joints between adjacent ground covering elements anywhere are no more than twice as long as one side of a basic element square, as will be explained in greater detail below, or as long as one leg of the outer angle side. Heretofore, the optimum compound effect of ground covering elements placed side by side has been obtained with the herringbone pattern of ground covering elements which are twice as long as they are wide. In that pattern the joints between adjacent ground covering elements everywhere are one and a half times as long as one ground covering element. By comparison, increased compound effect in the laid structure can be obtained with the ground covering elements of the present invention by virtue of a shorter joint length or a mean shorter joint length between adjacent ground covering elements, as will be explained in greater detail below in the description of certain embodiments. Another modification of the invention is characterized in that the periphery of each ground covering element is composed of a plurality of peripheral sections some of which lie at angles, preferably right angles, one to another and others of which lie in longitudinal continuation one of another, with each peripheral section having the same projection/recess trace as the others. This particular embodiment provides ground covering elements having a very regular projection/recess trace along the entire circumference, thus offering simple and varied opportunities for joining contiguous ground covering elements in the laying of pavements composed of the elements.

Quite generally, with this invention ground covering elements are preferred wherein the base line may be considered to be composed of at least three squares combined to have at least one rectangular change of the general direction of extension. In the area of the lines of combination of these squares there are dummy joint gaps, and in the area of the free sides of the squares there is the periphery formed with the projections and recesses. Preferbly, the dummy gaps extend parallel to projections and recesses at corresponding sides of the circumference. Preferably, the basic elements thus resulting from the squares are centrosymmetrical with respect to their midpoint if one considers the projections and recesses at the outer periphery and the course of the dummy gaps together.

Another modification of the invention is characterized in that the top side of the ground covering element is provided with a plurality of elevations, preferably of square or round configuration, which protrude above the level defined by the upper ends of the projections and recesses. Preferably, such an elevation is provided for each basic element as defined in the preceding paragraph. The elevations preferably extend to or almost to the respective inner extreme points of the recesses or dummy gaps. If the ground covering element has such elevations, the otherwise usual chamfer at the transition from top side to the peripheral surface of the ground covering element may be dispensed with because any material chipping off in this zone is no longer disturbing optically as there are elevations.

The ground covering elements according to the present invention normally have such size and thickness that they may be referred to as stone or plate. They may also be considered as being compound stones or compound plates because of the projections and recesses at the circumference. They are made preferably of concrete. It is preferred to use the ground covering elements according to the invention for covering plazas, courtyards, driveways, streets, paths, embankments, and the like.

By being provided in clusters of the elements joined together by rated rupture zones the ground covering elements thus far described may be combined in so-called laying units which are of interest above all for mechanically covering large areas with laying units of big dimensions. The facultative breaking zones may be constituted by dummy gaps of sufficient depth or by more point-like bridges of material. They are so dimensioned that break-up into the individual ground covering elements can be initiated by vibrators, traffic load, passing of heavy rollers, temperature stress, and the like.

The invention also relates to groups of ground covering elements as specified. A preferred group with especially good compound effect is characterized in that it consists of a plurality of side-by-side rows of the elements, with the angle apices of the outer angled sides of elements in each row lying at the angle apices of the inner angled sides of adjacent elements in the row and with the angled sides of the elements in all rows oriented in the same direction. A second preferred group is obtained by joining a second ground covering element to a first one such that it is rotated through 180° in the plane of the ground covering elements, the two elements together constituting a rectangle which has projections and recesses at its periphery. If desired, further such rectangles may be joined to the first one.

The most varied opportunities for laying ground covering elements according to the invention in a pattern are obtained if the projection/recess trace at the outer periphery of the basic elements described, considered in conjunction with the dummy gaps, is centrosymmetrical for each basic element and, moreover, parallel at opposite sides. The resulting ground covering elements are particularly preferred, and all embodiments to follow in this specification fulfill this principle.

BRIEF DESCRIPTION OF THE DRAWINGS

The invention and further developments thereof will be described further, by way of example, with reference to the accompanying drawings, in which.

DESCRIPTION OF PREFERRED EMBODIMENTS

Figure 1:
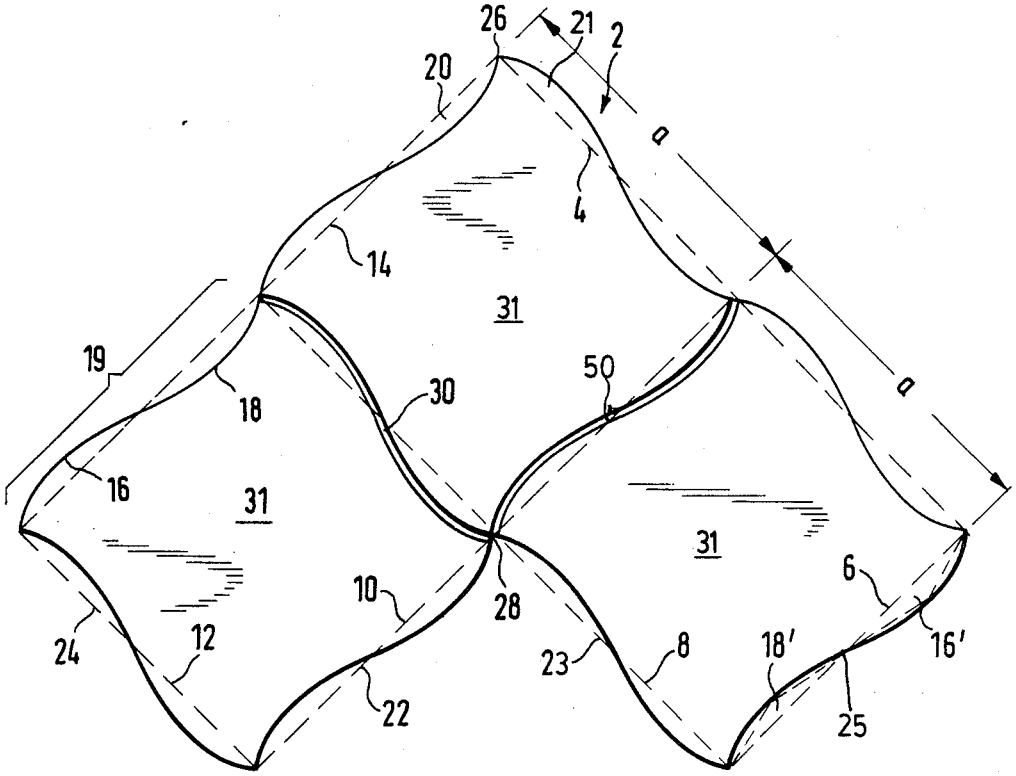
FIG. 1 is a top view of a ground covering element having rounded projections and recesses, a modified version, being indicated by discontinuous lines to have projections and recesses of planar delimitations, is seen at the lower right.

The ground covering element shown in FIG. 1 may most clearly be defined by starting from the base line. This base line consists of a rectilinear first section 4 of a length *2a*. This section is followed at right angles by a second rectilinear section 6 having a length a. A third rectilinear section 8 having a length a adjoins the free end of the second section 6 at right angles and parallel to the first section 4. A fourth rectilinear section 10 having a length a adjoins the free end of the third section 8 at right angles and in a direction away from the first section 4. A fifth rectilinear section 12 having a length a adjoins the free end of the fourth section 10 at right angles and parallel to the first section 4. A sixth rectilinear section 14 having a length *2a* leads back to the starting point from the free end of the fifth section 12, extending parallel to the second and fourth sections 6 and 10. Thus the closed base line 4, 6, 8, 10, 12, 14 has right angles at each corner, there being only two directions of base line sections and symmetry with respect to an axis embodied by a straight line through the points of intersection between sections 4 and 14, on the one hand, and sections 8 and 10, on the other hand. The base line also may be imagined to be the result of a combination at an angle composed of three squares. The base line determines an angular V-shaped basic configuration of the ground covering element 2, the general directions of extension of the two legs of the basic form, given by sections 4, 8 to embody one leg and sections 10, 14 to embody the other leg, including a right angle.

All around the circumference, or at all sides of the ground covering element 2 there are projections 16 and recesses 18 with respect to the base line 4, 6, 8, 10, 12, 14, having a sine-shaped delimitation as seen from the top. Specifically, starting from the initial end of the first section 4 at the respective side of the ground covering element there is one projection, followed by a recess, followed by another projection and another recess, the second half being an identical repetition of the first half. The same applies to the side of the sixth section 14, starting from the junction with the fifth section 12. The sides of the remaining sections 6, 8, 10, 12 each have one projection 16 only followed by an adjoining recess 18, the projection 16 being first in each instance when considering the line progressively in the same direction as the above description of sections 6, 8, 10, 12. Thus the projection/recess trace of the first section 4 is a repetition rotated through 90° of the projection/recess trace of the sixth section 14. The projection/recess trace of sections 6 and 10 represents a parallel displacement in the direction of the first section 4 of the respective opposed half of the sixth section 14. The projection/recess trace of sections 8 and 12 represents a parallel displacement in the direction of the sixth section 14 of the respective opposed half of the first section 4. The circumference of the ground covering element 2 may be imagined as being a line-up of eight identical peripheral sections 19, two peripheral sections 19 each being lined up in longitudinal continuation at sections 4 and 14, whereas at sections 6, 8, 10, 12 the peripheral sections 19 each are lined up at right angles in correspondence with the course of the base line.

Thus the ground covering element 2 has an outer angle sides 20 and 21 given by sections 4, 14 or the corresponding projection/recess trace, inner angle sides 22 and 34 given by sections 8, 10 or the corresponding projection/recess trace, and two front sides 24 and 25 given by sections 6 and 12, respectively, or the respective corresponding projection/recess trace. At the intersection of sections 4, 14 the outer angle sides 20 and 21 meet at an angle apex 26 which may be looked upon as being the tip of the ground covering element 2, and the inner sides 22 and 23 meet at an angle apex 28 at the intersection of related base line sections 8, 10.

From the inner angle apex 28 two dummy gaps 30 and 50 each lead to the center of the respective opposite side 20 or 21 of the ground covering element. Each dummy gap is an exact continuation of the direction and of the projection/recess trace of an inner angle side 22 or 23, and each is exactly parallel to the projection/recess trace at the parallel front side 24 or 25. If one looks at the projection/recess trace along the periphery and at the dummy gaps 30 and 50 together, the ground covering element 2 appears to be a combination of three identical basic elements or elemental units 31 joined into an angle and each having a centrosymmetrical relationship of the projection/recess trace and the dummy gap or dummy gaps at its four sides.

The depth of the dummy gaps 30 and 50 is from 10 to 30% of the thickness of the ground covering element 2.

At the right lower front side 24 in FIG. 1 a projection 16' and a recess 18' are indicated by discontinuous lines. They are formed by oblique faces extending at an inclination with respect to the second base line section 6, the tips of the projection 16' and recess 18', respectively, being located at the maximum or minimum of the previous sinusoidal trace. The adjacent oblique faces of the projection 16' and recess 18' pass over into each other. A modified version of the ground covering element 2 having sinusoidal projections and recesses 16, 18 and shown in continuous lines, may have the sine-shaped roundings replaced by a corresponding zig-zag trace around the entire circumference and at the dummy gaps 30 and 50. This will not influence the other characteristics of the ground covering element described.

Another modification, likewise not shown, of the ground covering element according to FIG. 1 may provide for the addition of another basic element corresponding to an elemental unit 31, joined to the half of the outer angle size 20 or 21 remote from the outer angle apex 26, either at section 4 or at section 14, interposing another dummy gap corresponding to gap 30 or 50. The angular configuration of the resulting ground covering element will have two rectangular changes of the general direction of extension.

Figure 2:
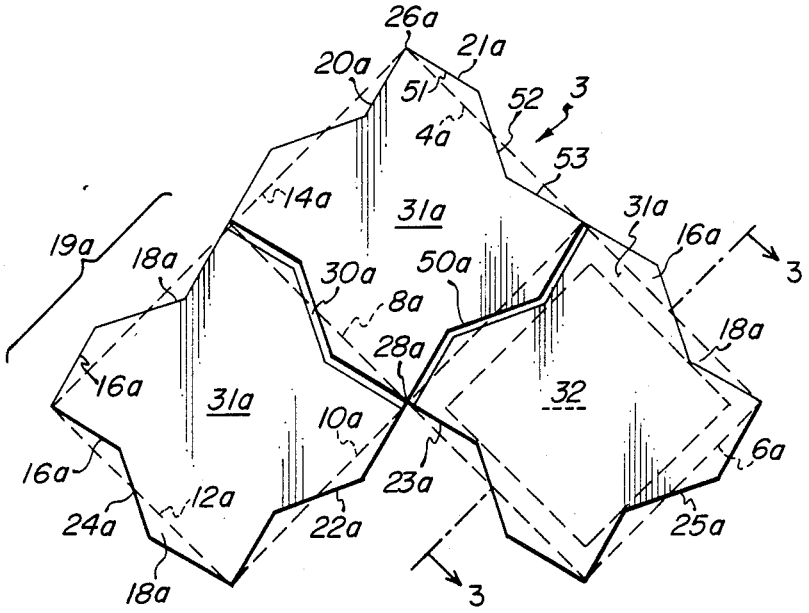
FIG. 2 is a top view of a ground covering element having projections and recesses which are delimited by oblique surfaces, the possibility of having elevations on the top side of the ground covering element being indicated by discontinuous lines at the right lower side.

FIG. 2 of the drawings shows another preferred embodiment of the invention. Features of parts denoted by reference numerals suffixed with an a in FIG. 2 correspond in description to the correspondingly numbered features or parts in FIG. 1 except as noted otherwise. Instead of the sine-shaped projections 16 and recesses 18, the projections **16*a* and recesses 18*a* in this case are zig-zag shaped, yet of a somewhat different course than the projections 16' and recesses 18' indicated in FIG. 1. Specifically, starting from the outer angle apex 26***a* a planar oblique face 51 of outer side 21*a* of the ground covering element 3 extends outwardly throughout one sixth of the length of the first base line section 4*a*. That face is followed for another sixth of the length of the first section by an inwardly directed planar oblique face 52, intersecting section 4*a* approximately at the midpoint of the length of face 52. For another sixth of the length of section 4*a* planar face 52 is followed by another planar face 53 directed outwardly with respect to the first section 4*a*. The same trace is repeated another time across the remaining three sixths of the first section 4*a*. In a manner similar to what has been specified for the sine-shaped trace of FIG. 1, this projection/recess trace establishes the projection/recess trace at the other sides 25*a*, 23*a*, 22*a*, 24*a* and 20*a* of the ground covering element 3 as well as the course of the dummy gaps 30*a* and 50*a* of this element. The illustrated trace of the projections 16*a* and recesses 18*a* and of the dummy gaps 30*a* and 50*a* may be replaced by a rounded trace adapted accordingly. This will not produce an accurate sine-shaped trace but instead a trace which might be called an obliquely compressed trace. It applies to both, the embodiment shown in FIG. 1 as well as the one shown in FIG. 2, that a rounded projection/recess trace may be obtained also by lined-up circular arc sections, for example, and that it is likewise possible to provide combinations of rounded sections and planar face sections extending obliquely with respect to the base line curve and/or in portions parallel to the base line curve, or combinations of sections which are inclined with respect to the base line curve and sections which are parallel to the base line curve in portions.

Figure 2A:
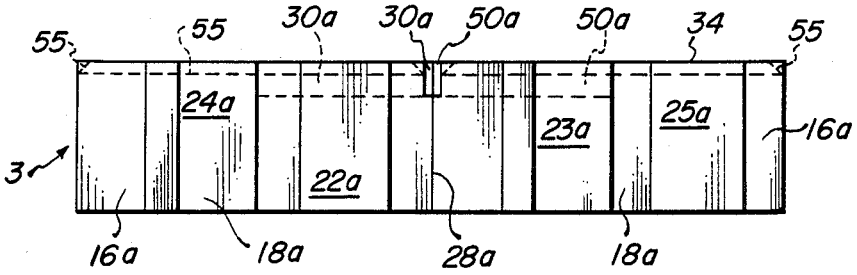
FIG. 2A is a side elevational view of the element shown in full lines in FIG. 2, with indications by broken lines of the course of the dummy gaps and of the usual chamfer along top edges of the element.

FIG. 2A is a side elevational view of the ground covering element 3 of FIG. 2, with showings in broken lines of the usual top edge chamfer 55 at the transition between the peripheral side faces and the top side 34 of the element.

The embodiments described above have the side faces of the ground covering element 2 or 3 perpendicular to the top side thereof. This perpendicular arrangement may be deviated from in that, for instance, ground covering elements may be formed with vertical toothing at the periphery.

Figure 3:
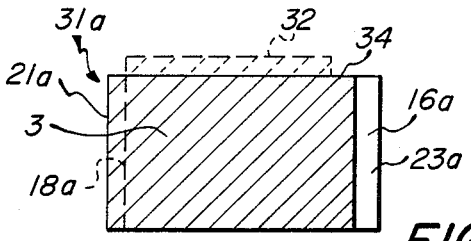
FIG. 3 is a vertical section of the ground covering element taken along line III—III in FIG. 2.

The right lower basic element and FIG. 3 elemental unit 31*a* in FIG. 2 and FIG. 3 is shown by discontinuous lines as having a square elevation 32 rising a few millimeters above the level 34 of the top of the peripheral sides and the dummy gaps of the ground covering element 3. The elevation 32 extends all the way or almost to the corners of the recesses 18*a*. FIG. 3 shows that in such an embodiment the chamfer which frequently is provided at the transition between the top side 34 and the peripheral faces 21*a*, 23*a*, etc. of the ground covering element is dispensed with. The sides of the raised square are parallel to the corresponding base line sections. Instead of a single elevation 32 a plurality of elevations may be provided per basic element or unit 31*a*. Also, the outline of the elevation may differ from the square shape shown. Of particular interest in connection with the embodiment shown in FIG. 1 is an elevation of circular shape. It is likewise possible to provide elevations having polygonal configurations, especially irregular polygons, as seen from the top. If an embodiment with elevations is chosen, it will be understood that normally all basic elements, or elemental units, 31 or 31*a* of the ground covering element 2 or 3 will have one or more elevations.

Figure 4:
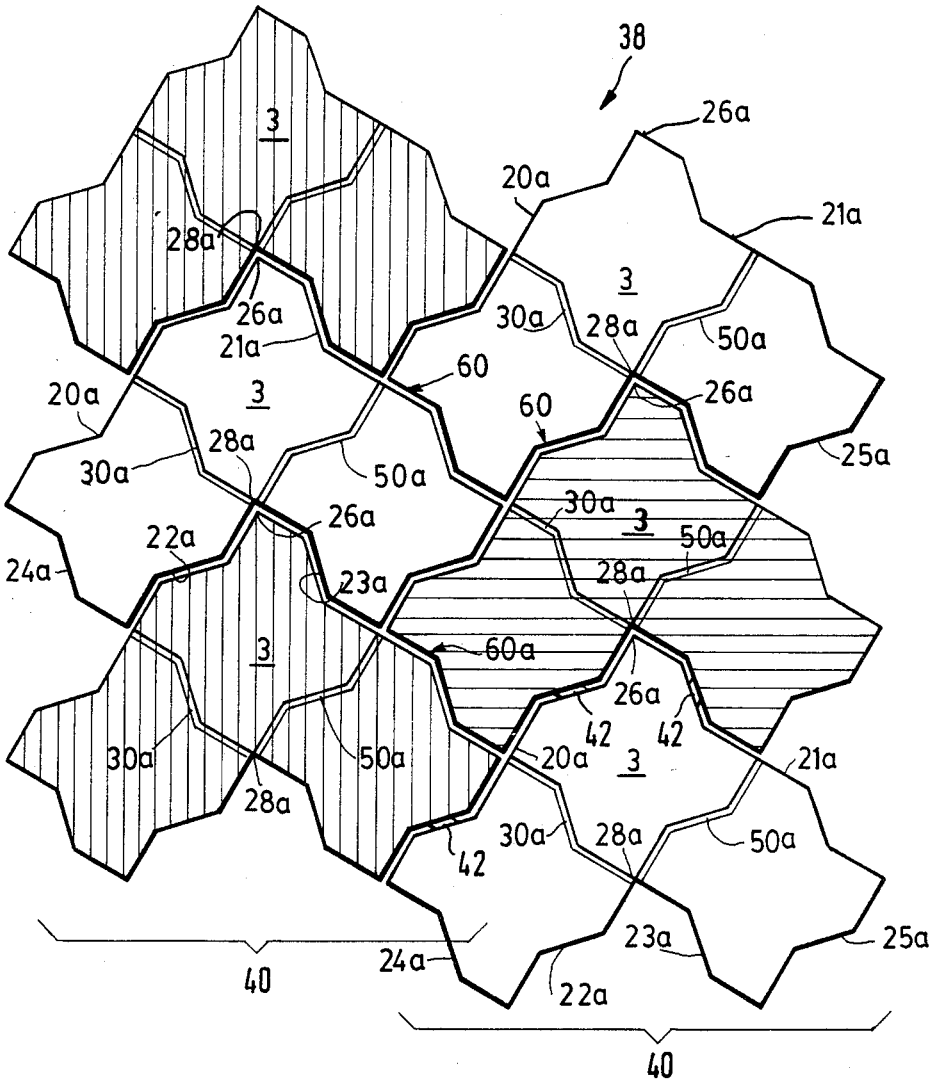
FIG. 4 is a top view of a group of ground covering elements, a possibility of combining the group of ground covering elements into an integral laying unit being indicated at the right lower side.

FIG. 4 shows a group 38 of six ground covering elements 3 of the type described with reference to FIG. 2 and FIG. 2A. Some of the ground covering elements 3 are shown with coarse cross hatching in the interest of better clarity of the drawing; this is not meant to indicate a section. Three ground covering elements 3 are shown as being arranged in each of two rows 40. In each row, each lower ground covering element 3 is placed with its outer angle apex 26*a* adjacent the inner apex angle 28*a* of the next higher ground covering element 3. The elements 3 of a right row 40 of the same structure as the left row 40 in FIG. 4 fit interlockingly with the elements 3 of the left row. In both rows 40, as to all the ground covering elements 3 the outer angle sides 20*a* and 21*a* and the inner angle sides 22*a* and 23*a* of each element converge upwardly in the middle so that the ground covering elements in both rows 40 have the same orientation. It will be recognized that in the interior of the group 38 the (space) joints 60 between adjacent ground covering elements 3 in each instance extend for the length 2*a* (see FIG. 1). Now, if the right row in FIG. 4 were rotated through 180° in the plane of the drawing and then again fitted against the left row 40, the resulting configuration would have joints between the adjacent ground covering elements 3 extending in some places over a length a and in, other places over a length 3*a*.

The relationship explained with regard to the length of the joints will remain the same in larger groups of more than six of the ground covering elements.

It is indicated between two ground covering elements 3 at the lower right in FIG. 4 that the individual ground covering elements 3, for example, may be connected by facultative rupture webs 42 to form a laying unit. By way of example, two such facultative rupture webs 42 may be provided per outer angle side 20*a* or 21*a* one being disposed at one fourth of the length of the side and the other one at three fourth of the length, all within the interior of the laying unit. In this manner a large laying unit is obtained which, for instance, is composed of six elements interconnected by facultative rupture webs 42, each individual element being in the form of the ground covering element 3 as shown in FIG. 2. Such a big laying unit may be used for mechanical laying, and the facultative rupture webs 42 may break when a certain limit load is surpassed. Instead of the facultative rupture webs 42, connections of material may be provided to extend along the entire border line between adjacent ground covering elements 3 leaving at the top a dummy gap which follows the same course as the dummy gaps 30*a* and 50*a* but has greater depth. What has been explained above with regard to the trace of the projections 16*a* and recesses 18*a* and to the course of the dummy gaps 30*a* and 50*a*, as well as the elevations 32, applies to the laying units, too, which are composed of numbers of the ground covering elements breakably joined together.

What we claim is:

1. Modular elements of substantially uniform configuration layable side-by-side to form ground covering or load bearing pavements, each of said elements consisting essentially of a unitary rigid body substantially larger in horizontal dimensions than it is thick and bounded peripherally by two generally right angularly related inner sides each extending from an end thereof to , and meeting the other at an inner angle apex, two generally right angularly related outer sides each extending from an end thereof to, and meeting the other at an outer angle apex, and two front sides each extending between the respective ends of a said inner side and a said outer side;

said body having formed in and across its top side two dummy joint gaps each of which extends substantially as a continuation of one of said inner sides from said inner angle apex to a midpoint between half sections of one of said outer sides;

said inner sides, said front sides, said half sections of said outer sides and said dummy gaps being of substantially the same length and of substantially the same longitudinal configuration with each having at least one longitudinal portion thereof projecting outside and at least one longitudinal portion thereof recessed inside an imaginary straight base line between the ends thereof, so that said top side appears visually to be composed of three substantially indentical four-sided elemental units disposed side by side with the respective opposite side configurations of each elemental unit parallel to each other and any one of said elements will mate and interlock laterally at all its peripheral sides with sides of others of said elements, yet will present with them substantially the same pavement surface appearance, in any of a variety of side-by-side orientations of the elements.

2. Modular elements according to claim 1, said inner sides, said front sides, said half sections of said outer sides and said dummy gaps each having a sinusoidal configuration comprising outer and inner curved side portions lying respectively at opposite sides of the related said base line.

3. Modular elements according to claim 1, said inner sides, said front sides, said half sections of said outer sides and said dummy gaps each having the configuration of a succession of substantially straight side portions extending obliquely in alternate directions relative to the related said base line.

4. Modular elements according to claim 1, 2, or 3, said top side of each element being provided with a plurality of elevations which protrude above the level of the top of said sides and said dummy gaps.

5. Modular elements according to claim 4, each of said three elemental units of each element being provided with a said elevation which extends over nearly the entire top area of the respective elemental unit inside the configurations of its bordering sides and dummy gap or gaps.

6. A laying unit consisting essentially of a cluster of modular elements according to claim 1, 2, or 3 arranged each in side-by-side interlocking relation to others and each joined to others by facultative rupture means.

7. A group of modular elements according to claim 1, 2 or 3, comprising a plurality of side-by-side rows of said elements arranged with the respective outer angle apices of elements in a row lying at the respective inner angle apices of adjacent elements in the same row, and with the respective outer sides and inner sides of the elements in said rows oriented in the same direction.

8. A laying unit consisting essentially of a cluster of modular elements according to claim 5 arranged each in side-by-side interlocking relation to others and each joined to others by facultative rupture means.

9. A group of modular elements according to claim 5, comprising a plurality of side-by-side rows of said elements arranged with the respective outer angle apices of elements in a row lying at the respective inner angle apices of adjacent elements in the same row, and with the respective outer sides and inner sides of the elements in said rows oriented in the same direction.

10. Modular paving elements according to claim 5, each said elevation being square in configuration.

11. Modular elements according to claim 1, said dummy gaps being sufficiently deep that they constitute in each said element weakened regions along which the element when overloaded can break preferentially so as to preserve both an interlocking relationship of its elemental units and substantially the original appearance of its top side.

* * * * *